US011014258B2

(12) United States Patent
Bader et al.

(10) Patent No.: US 11,014,258 B2
(45) Date of Patent: May 25, 2021

(54) DELAY UNIT, UNROLLING DEVICE, CUTTING MACHINE AND METHOD FOR PROVIDING SEPARATING MATERIAL

(71) Applicant: GEA Food Solutions Germany GmbH, Biedenkopf-Wallau (DE)

(72) Inventors: Christian Bader, Mauerstetten (DE); Florian Mohr, Moosbach (DE)

(73) Assignee: GEA Food Solutions Germany GmbH, Biedenkopf-Wallau (DE)

( * ) Notice: Subject to any disclaimer, the term of this patent is extended or adjusted under 35 U.S.C. 154(b) by 39 days.

(21) Appl. No.: 16/470,303

(22) PCT Filed: Dec. 20, 2017

(86) PCT No.: PCT/EP2017/083912

§ 371 (c)(1),
(2) Date: Jun. 17, 2019

(87) PCT Pub. No.: WO2018/115178

PCT Pub. Date: Jun. 28, 2018

(65) Prior Publication Data

US 2019/0329438 A1 Oct. 31, 2019

(30) Foreign Application Priority Data

Dec. 20, 2016 (DE) ..... 10 2016 225 558.4

(51) Int. Cl.
*B26D 7/32* (2006.01)
*B26D 5/00* (2006.01)
(Continued)

(52) U.S. Cl.
CPC ..... *B26D 7/325* (2013.01); *B26D 5/00* (2013.01); *B65H 23/10* (2013.01); *B65H 35/08* (2013.01);
(Continued)

(58) Field of Classification Search
CPC ..... B26D 2007/322; B26D 2210/02; B26D 5/00; B26D 7/325; B65H 23/10;
(Continued)

(56) References Cited

U.S. PATENT DOCUMENTS 3,848,757 A * 11/1974 Jordan ..... B65B 35/50 414/802
4,070,951 A * 1/1978 Bala ..... B65H 20/24 493/24
(Continued)

FOREIGN PATENT DOCUMENTS

DE 601816 C 8/1934
DE 1499001 A1 8/1969
(Continued)

OTHER PUBLICATIONS

International Search Report for International Application No. PCT/EP2017/083912, dated Jul. 12, 2018.
(Continued)

*Primary Examiner* — Stephen Choi
(74) *Attorney, Agent, or Firm* — The Dobrusin Law Firm, P.C.

(57) ABSTRACT

A cutting machine that includes a knife and an unrolling device. The knife severs foodstuff slices from a foodstuff bar. A leaf from a separating material is provided between at least two foodstuff slices. The unrolling device providing the separating material for disposal of the leaf between the two foodstuff slices and injects the leaf into the cutting region. The unrolling device has a tape roll and a delay unit. disposed downstream of the tape roll. The delay unit is configured for delaying the movement of the separating material, which is unrolled from the unrolling device and is provided in a cutting region of a cutting machine.

11 Claims, 1 Drawing Sheet

(51) Int. Cl.
*B65H 23/10* (2006.01)
*B65H 35/08* (2006.01)

(52) U.S. Cl.
CPC .... *B26D 2007/322* (2013.01); *B26D 2210/02* (2013.01); *B65H 2406/31* (2013.01); *B65H 2801/81* (2013.01)

(58) Field of Classification Search
CPC ..... B65H 2406/10; B65H 2406/31; B65H 2406/3662; B65H 2801/81; B65H 35/08
See application file for complete search history.

(56) References Cited

U.S. PATENT DOCUMENTS

| | | | | |
|---|---|---|---|---|
| 4,750,765 | A * | 6/1988 | Cassidy | F16L 37/088 285/321 |
| 2015/0053057 | A1 | 2/2015 | Dreier et al. | |
| 2018/0112808 | A1* | 4/2018 | Madocks | F16L 37/23 |
| 2018/0132444 | A1* | 5/2018 | Balkenhol | F16L 23/10 |

FOREIGN PATENT DOCUMENTS

| | | | |
|---|---|---|---|
| DE | 3439618 | A1 | 4/1986 |
| DE | 4125539 | A1 | 2/1993 |
| DE | 9301670 | U1 | 5/1993 |

OTHER PUBLICATIONS

International Preliminary Report on Patentability for International Application No. PCT/EP2017/083912; dated Feb. 20, 2019.

* cited by examiner

DELAY UNIT, UNROLLING DEVICE, CUTTING MACHINE AND METHOD FOR PROVIDING SEPARATING MATERIAL

BACKGROUND

The present invention proceeds from a delay unit for an unrolling device, wherein the delay unit is configured for delaying a transporting movement of separating material which is unrolled from the unrolling device and is provided in a cutting region of a cutting machine.

Such delay units are known from the prior art and serve for keeping the separating material under tension when unrolling, said separating material typically comprising a tape of film or paper material. On account thereof the transporting resistance of the tape is increased such that the tape does not kink, tear, or back up. The separating material is typically referred to as an "interleaver" and the tape is typically referred to as an "interleaver strip".

Such delay units in the prior art are at all times used as rollers, in particular dancer rollers, the tape running about the latter. Such dancer rollers are typically configured so as to be movable and are pretensioned in a spring-elastic manner in one direction.

Roller-based delay units of this type for interleaver strips are known, for example, from the German patent application DE 10 2013 204 956 A1. The interleaver strip here is guided by way of U-shaped cartridges with interleaver rollers which are in each case provided with a braking means. The braking means comprise a braking mandrel which acts on the respective interleaver roller and by way of friction generates a braking torque.

A method for positioning interleaver strips between foodstuff slices is known from publication DE 41 25 539 A1, wherein the interleaver material is fed as a tape and when feeding is decelerated in the movement of said tape by feeding rollers of a delay unit.

It is disadvantageous in these delay units that the braking torque is not capable of being set with the desired precision, and heavy wear is created on the interleaver rollers on account of the friction that is initiated in an artificial manner.

SUMMARY

It is an object of the present invention to provide a cutting machine having a delay unit for an unrolling device which does not have the afore-mentioned disadvantages of the prior art and moreover can be implemented in a cost-effective manner and is readily adaptable to different geometries of separating materials.

The object is achieved by a cutting machine as claimed in claim 1.

The delay unit according to the invention in relation to the prior art thus has the advantage that the transporting movement of the separating material is not delayed by mechanically braking an interleaver roller, but is delayed by exerting pressure on the separating material per se. For example, the separating material by means of positive pressure or by means of negative pressure can be pressed onto a bearing face or suction plate which is replaceable and thus individually adaptable to the geometry of the separating material, on account of which the desired delay effect arises. Positive pressure as well as negative pressure (thus in the context of the present invention referring in each case to the positive or the negative pressure differential relative to the ambient pressure) can advantageously be adjusted in a comparatively precise and simple manner, on account of which the desired delay effect is controllable. Moreover, the delay unit can be more easily replaced, for example for the purpose of maintenance or cleaning, since the in particular tape-shaped separating material does not have to be guided over a roller of the delay unit. A further advantage is that the overall number of rollers can be significantly reduced in relation to the prior art, on account of which the delay unit according to the invention can be designed so as to be more compact, lighter, cheaper, and less maintenance intensive. The separating material preferably comprises a tape from film or paper material. The separating material in the context of the present invention is also referred to as an "interleaver", and the tape is referred to as an "interleaver strip".

The delay unit according to the invention comprises a suctioning means for suctioning the separating material by means of negative pressure. The movement of the separating material is thus delayed by suctioning the separating material by means of negative pressure. The negative pressure is preferably accurately adjustable such that the braking effect can be adapted to different conditions and separating materials in a precise, rapid, and simple manner. Suctioning by means of "negative pressure" in the context of the present invention means in particular that in the region, or within the suctioning means, respectively, a pressure prevails that is lower as compared to the ambient pressure of the delay unit. The ambient pressure will typically correspond to the mean air pressure, for example 1 bar at sea level. On account of the pressure differential, air flows to the suctioning means, on account of which the separating material is suctioned to the suctioning means. A type of (static) friction between the separating material and the suctioning means is created on account of the suctioning, so that the transporting resistance in the transporting movement, which is in particular aligned so as to be perpendicular to the suctioning direction, increases and the separating material is thus braked. The braking in a known manner has the effect that the separating material and in particular the tape remains tensioned, ensuring that the separating material is unrolled and provided in an orderly manner without said separating material kinking, tearing, or backing up.

According to one preferred embodiment of the present invention it is provided that the suctioning means comprises a suction plate having at least one suction opening, wherein the suction opening by way of a fluid line is fluidically connected to a suction unit. The configuration of the suctioning means as a suction plate has the advantage that the separating material when suctioning the latter can bear in a planar manner on the suctioning means, on account of which the transporting resistance is increased. The geometry of the suction plate is preferably individually adapted to the geometry of the separating material. The suction plate is in particular replaceable in a modular manner, so that the delay unit in the case of a changeover of the separating material can be adapted to the geometry of the new separating material in a simple manner by way of a corresponding replacement of the suction plate. The suction plate is preferably provided with a multiplicity of suction openings which are in each case fluidically connected to the fluid line. The suction openings are either distributed uniformly across the surface of the planar suction plate, or a plurality of the suction openings are disposed in a central region or a peripheral region of the suction plate.

According to one preferred embodiment of the present invention it is provided that the suction unit comprises a negative-pressure-generating unit, in particular a fan, a Venturi nozzle, a vacuum pump, or the like. The use of a fan represents a comparatively cost-effective solution that is easy to implement. The fan comprises in particular a housing in which a fan wheel that is driven by an electric motor rotates. The fan wheel is disposed on a shah that is connected to the electric motor and has a rim of vanes set at an attitude. The rotating speed of the fan wheel is determined by the rotating speed of the electric motor by way of the shaft. The rotating speed of the motor is preferably controlled by way of a control unit. The negative pressure generated in the suction openings of the suction plate for suctioning the separating material depends on the air throughput of the fan, said air throughput being determined by the constructional parameters of the fan as well as by the rotating speed of the fan wheel. The negative pressure can thus advantageously be set by way of a modification of the rotating speed such that the transporting resistance can advantageously be set in a stepless manner and in an extremely precise manner by controlling the rotating speed of the fan wheel by means of the control unit. It is conceivable that the control unit has for controlling the rotating speed of the fan, wherein the control unit is in particular configured in such a manner that the rotating speed of the fan is controlled as a function of an unrolling and/or transporting speed of the separating material. It is conceivable that the unrolling or transporting speed is measured by means of a sensor. In this case, the fan is preferably controlled by way of a closed-loop control circuit in which the rotating speed of the fan wheel is incorporated as a manipulated variable and the unrolling or transporting speed (actual speed) is incorporated as a regulating and feedback variable. The unrolling and transporting speed is in this way automatically maintained in a predefined nominal range. When an actual speed that exceeds the nominal range is measured by the sensor, the rotating speed of the fan is automatically increased until the actual speed lies within the nominal range again. By contrast, when an actual speed that falls short of the nominal range is measured by the sensor, the rotating speed of the fan is automatically reduced until the actual speed lies within the nominal range again.

According to one preferred embodiment of the present invention it is provided that the fluid line by way of a quick-release coupling is operatively connected in a releasable manner to the suctioning means, wherein the coupling unit is in particular capable of being coupled to a plurality of different and mutually replaceable suction plates. The quick-release coupling advantageously enables the delay unit to be capable of being equipped with different suction plates in a rapid and simple manner, on account of which the delay units is adaptable to different separating materials and separating material geometries. The different suction plates differ in particular in terms of the dimensions thereof and/or in terms of the number, size thereof, and/or the arrangement of suction openings.

Alternatively to the use of the suctioning means it is conceivable that the pressure-generating means comprises a contact pressure means 28 (schematically illustrated in FIG. 1) for pressing the separating material onto a bearing face by means of compressed air, wherein the pressure-generating means preferably has a compressor or fan for generating the compressed air, and/or a nozzle for generating an air stream that is directed in the direction of the separating material. The separating material by means of the air stream is in particular pressed in a planar manner against the contact pressure means which is configured in the form of a contact pressure plate that is replaceable in a modular manner, on account of which a friction-fit is created between the separating material and the contact pressure plate. The friction effect depends on the intensity of the air stream, thus on the intensity of the positive pressure.

Pressure differential between a contact pressure by means of "positive pressure" in the context of the present invention means in particular that in the region, or within the pressure-generating means, respectively, a pressure prevails that is higher as compared to the ambient pressure of the delay unit. The ambient pressure will typically correspond to the mean air pressure, for example 1 bar at sea level. Air flows out of the pressure-generating means on account of the pressure differential. The separating material is pressed onto the contact pressure plate on account of the air stream that is created herein. To this end, the air stream is directed either directly, preferably perpendicularly, onto the separating material so that the separating material by the air stream is moved in the direction of the contact pressure plate, or the air jet is directed into a gap between the separating material and the contact pressure plate so that the separating material is pressed against the contact pressure plate on account of the Venturi effect. The positive pressure is preferably provided by a compressor or a fan. It is conceivable for the rotating speed of the fan wheel of said fan to be controlled as a function of the transporting speed of the separating material, the conveying speed of the foodstuff bar, or the rotating speed of the knife, as has been explained in the context of the fan of the suctioning means.

The unrolling device has a tape roll for providing separating material, and the delay unit, wherein the delay unit along the transporting movement of the separating material is disposed downstream of the tape roll. The transporting resistance of the separating material that is unrolled from the tape roll is advantageously increased by means of the delay unit such that always that much separating material is unrolled from the tape roll as is actually required. It is thus in particular prevented that, by virtue of an insufficient rolling resistance of the tape roll, more separating material is unrolled than can be received, thus arising, for example, in the tape material backing up or jumping from the tape roll. It is conceivable for the unrolling device to be a multi-track unrolling device which provides a plurality of separating-material tapes in parallel. In this case, the unrolling device preferably has a plurality of tape rolls that are disposed in parallel and a corresponding plurality of delay units that are disposed in parallel. The unrolling device according to the invention advantageously has a severing installation for cutting a leaf from the (ape from separating material, wherein each leaf is severed by the severing installation before, during, or after the leaf, or the free end of the tape from separating material, respectively, is injected into a cutting region of a cutting machine for cutting foodstuffs. The transport of the tape herein is performed in particular in an intermittent manner. Said intermittent conveying of the separating material is preferably performed by means of a drive of the unrolling device, wherein the drive along the transporting direction of the separating material in the direction of the cutting machine is disposed behind the delay unit, thus between the cutting machine and the cutting region. The drive comprises in particular a motor-driven roller by way of which the tape from separating material is guided. The drive is particularly preferably disposed along the transporting direction of the separating material so as to be between the delay unit and the severing installation. Optionally, it is conceivable for the unrolling device to have a further drive which is provided for driving the tape roll. Alternatively, the tape roll can also be configured so as to have a freewheeling mechanism or a braked freewheeling mechanism.

The cutting machine according to the invention for cutting foodstuff bars has a knife which severs foodstuff slices from a foodstuff bar, said foodstuff slices being disposed so as to at least partially overlap so as to form a portion of a plurality of foodstuff slices, wherein a leaf from separating material is provided between at least two foodstuff slices, wherein the cutting machine has the unrolling device according to the invention, said unrolling device providing the separating material for the disposal of the leaf between the two foodstuff slices. The cutting machine according to the invention in relation to cutting machines known from the prior art has the advantage that inserting or injecting the separating-material leaf between two foodstuff slices that have been severed from the foodstuff bar and are partially slacked on top of one another functions in a particularly reliable manner since a precise and individually adaptable setting of the transporting resistance can be performed on account of the use of the delay unit according to the invention. It can in particular be ensured herein that only that much separating material is unrolled from the tape roll as is actually required for the current slicing and portioning procedure. Moreover, the cutting machine can be adapted in a simple manner to different foodstuffs which, for example, require separating materials of different dimensions, since the delay unit is also convertible in a simple and rapid manner by replacing the suction plate. Frequent cleaning of the machining components is a fundamental requirement in foodstuff-processing machines. The cutting machine according to the invention in this context offers the advantage that the suction plate of the delay unit is readily and rapidly retrievable and re-insertable for cleaning purposes. It is conceivable for the cutting machine to be a multi-track cutting machine which cuts a plurality of foodstuff bars in parallel and disposes said foodstuff bars so as to form at least partially overlapping stacks (also referred to as portions) of foodstuff slices. In this case, the unrolling device correspondingly comprises a multi-track unrolling device so that individual leaves from separating material can be disposed between foodstuff slices that are stacked on top of one another of each stack prepared in parallel.

According to one preferred embodiment of the present invention it is provided that the knife comprises a rotating cutting knife, and the suctioning means comprises a suction plate having at least one suction opening which by way of a fluid line is fluidically connected to a suction unit in the form of a fan, wherein the delay unit has a control unit for controlling the rotating speed of the fan, said fan being configured in such a manner that the rotating speed thereof is controlled as a function of an unrolling and/or transporting speed of the separating material and/or of the rotating speed of the cutting knife and/or of a conveying speed of the foodstuff bar in the direction of the cutting knife. The rotating speed of the cutting knife and/or the conveying speed of the foodstuff bar is a measure for the rate at which foodstuff slices are severed and stacked. The demand for separating material is a direct function of said rate so that the rotating speed of the cutting knife and/or the conveying speed of the foodstuff bar can be resorted to as a controlling or regulating variable for actuating the fan and thus ultimately for the transporting resistance of the separating material. It is conceivable for the fan to be controlled by way of a closed-loop control circuit (as has been described above), in which the rotating speed of the fan wheel is incorporated as a manipulated variable, and the rotating speed of the cutting knife and/or the conveying speed of the foodstuff bar are incorporated, instead of or additionally to the unrolling or transporting speed of the separating material, as a regulating and feedback variable.

A further subject matter of the present invention for solving the object mentioned at the outset is a method for providing separating material, wherein the separating material is unrolled from a tape roll and is provided in a cutting region of a cutting machine, wherein a transporting movement of the separating material from the tape roll to the cutting region is delayed by a delay unit, wherein, for delaying the transporting movement, pressure on the separating material is generated by means of a pressure-generating means. According to the invention, the separating material for delaying the transporting movement is suctioned by a suctioning means by means of negative pressure, it has already been explained above that the suctioning of the separating material can advantageously be precisely set by way of adjusting the negative pressure and is adaptable in a stepless manner, such that an optimal adaptation of the transporting resistance is enabled at any time.

According to one preferred embodiment of the present invention it is provided that, for delaying the transporting movement, the separating material is suctioned in particular in a planar manner onto a suction plate, wherein the negative pressure is generated by a negative-pressure-generating unit in the form of a fan, said negative-pressure-generating unit by way of a fluid line being fluidically connected to at least one suction opening in the suction plate.

According to one preferred embodiment of the present invention it is provided that a rotating speed of the fan is controlled as a function of an unrolling and/or transporting speed of the separating material and/or of a rotating speed of a rotating cutting knife of the cutting machine of a control unit.

According to one preferred embodiment of the present invention it is provided that foodstuff slices are severed from a foodstuff bar by means of the cutting knife, and wherein the foodstuff slices are disposed so as to at least partially overlap so as to form a portion of a plurality of foodstuff slices, wherein a leaf that is severed from the separating material is disposed between at least two foodstuff slices.

According to an alternative embodiment of the present invention it is provided that for delaying the transporting movement the separating material is in particular suctioned in a planar manner onto a suction plate, wherein the negative pressure is generated by a negative-pressure-generating unit in the form of a fan, said negative-pressure-generating unit by wav of a fluid line being fluidically connected to at least one suction opening in the suction plate. It is conceivable for the rotating speed of the fan wheel of said fan to be controlled as a function of the transporting speed of the separating material, of the conveying speed of the foodstuff bar, or of the rotating speed of the knife, as has been explained in the context of the fan of the suctioning means.

Further details, features, and advantages of the invention are derived from the drawings as well as from the description hereunder of preferred embodiments by means of the drawings.

The drawings herein illustrate only exemplary embodiments of the invention which do not limit the essential concept of the invention.

DETAILED DESCRIPTION

In both figures, identical parts are al all times provided with the same reference signs and are in each case therefore typically also identified or mentioned, respectively, only once.

Figure 1:
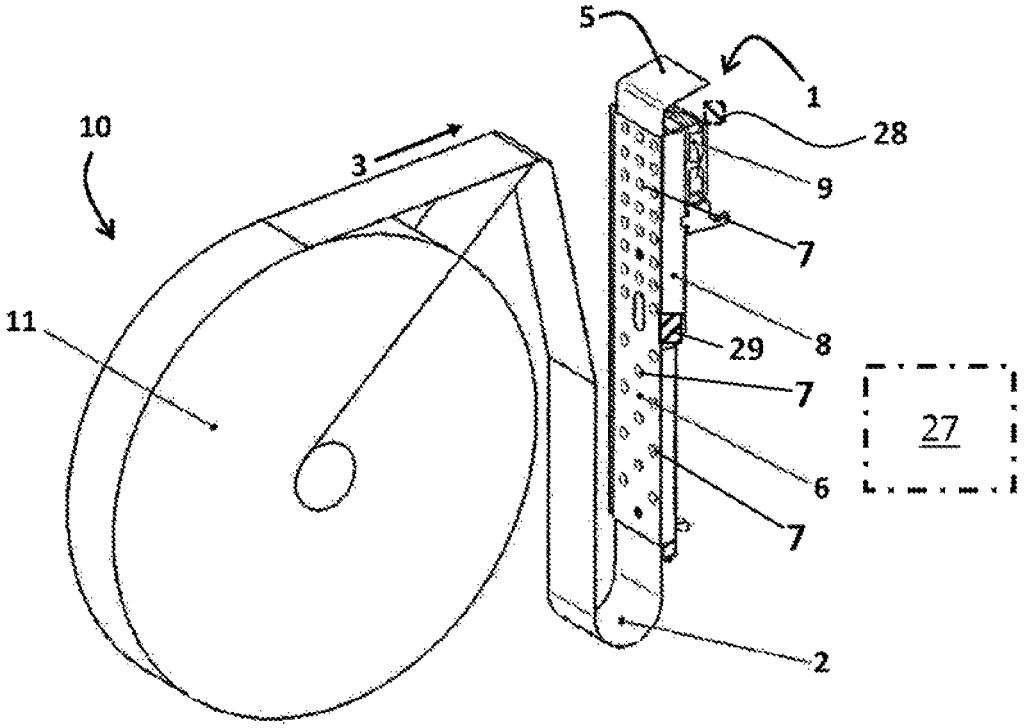
FIG. 1 shows a schematic perspective view of an unrolling device having a delay unit according to one exemplary embodiment of the present invention.

An unrolling device 10 according to an exemplary embodiment of the present invention is schematically illustrated in FIG. 1. The unrolling device 10 comprises a tape roll 11 on which al least one rolled-up tape from separating material 2 is provided. The tape comprises in particular an interleaver strip from which individual separating-material leaves 5, so-called interleavers, are successively severed in a cutting machine 20 (see FIG. 2), so as to dispose said separating-material leaves 5 between foodstuff slices 22 that are partially layered on top of one another and to prevent the foodstuff slices from adhering to one another.

The tape in the context of a transporting movement 3 is first guided from the tape roll 11 which is freewheeling or driven by a further drive (not illustrated) by way of (in the present example) two deflection rollers 4 to a delay unit 1. A person skilled in the art will appreciate that none, only one or more than two deflection rollers 4 could also be disposed between the tape roll 11 and the delay unit 1. Behind the delay unit 1 the tape is fed to the cutting machine (not illustrated in FIG. 1). The individual separating-material leaves 5 in the cutting machine 20 are severed from the tape by means of a separate severing installation and injected between the foodstuff slices 22 that are severed by a knife 21 of the cutting machine 20. A drive (not illustrated) which in an intermittent manner conveys the separating material 2 in the direction of the cutting machine 20 and herein unrolls said separating material 2 from the tape roll 11 is between the severing installation and the delay unit. The drive comprises in particular a motor-driven roller by way of which the tape of separating material 2 is guided. It is conceivable for an air stream to be incorporated in the cutting region, by wav of which air stream the respective leaf that is severed and is injected in an intermittent manner by means of the Venturi effect clings to the front side of the foodstuff slice just severed, and subsequently when portioning the foodstuff slice just severed thereafter lies under the latter on the stack of deposited foodstuff slices.

The delay unit 1 serves for delaying the transporting movement 3 of the tape along the transporting direction, said transporting movement 3 being caused by the drive, so as to increase the transporting resistance of the tape. It is ensured in this way that the tape when unrolling from the tape roll 11 is at all times tensioned and the tape does not jump from the tape roll 11 or from the deflection rollers 4, or kinks, tears, or backs up. It is achieved in particular that only that much separating material 2 is unrolled from the tape roll 11 as is required by the cutting machine 20 for disposal between the foodstuff slices 22.

The delay unit 1 according to the invention comprises a suctioning means in the form of a planar suction plate 6 which is penetrated by a multiplicity of suction openings 7. A fluid line 8 which is fluidically connected to the suction openings 7 is disposed on the rear side of the suction plate 6. The fluid line 8 leads to a negative-pressure-generating unit in the form of a fan 9. The fan 9 has a housing in which a fan wheel that is driven by an electric motor is disposed. The fan wheel has a rim of vanes that are set at an attitude (not illustrated).

The attitude angle and the rotating direction of the fan wheel are provided in such a manner that the fan 9 during the operation thereof suctions air from the fluid line 8 and conveys said air to the outside. On account thereof, a negative pressure (also referred to as a vacuum) in relation to the ambient pressure of the delay unit is created in the fluid line 8 and in the region of the suction openings 7, on account of which air is suctioned through the suction openings 7 in the direction of the fan 9 in the region of the suction plate 6. As a result of the tape running in the region of the suction plate 6, the tape is suctioned onto the suction plate 6 and clings in a planar manner to the suction plate 6. The mechanical contact between the tape and the surface of the suction plate 6 leads to a frictional contact which increases the transporting resistance of the tape. The transporting resistance depends directly on how intensely the tape is suctioned to the suction plate 6 and thus on the pressure differential between the negative pressure in the interior of the fluid line 7 and the ambient pressure. The pressure differential depends on the conveyed volume of the fan 9.

In the present case, the rotating speed of the fan wheel, by means of a control unit 27 schematically illustrated in FIG. 1, is controllable optionally in a stepless manner such that the pressure differential and thus ultimately the transporting resistance are also controllable in a stepless manner. It is conceivable for the fan to be controlled in a closed-loop manner by means of a closed-loop control circuit. For example, the rotating speed of the fan wheel is controlled in a closed-loop manner or at least in an open-loop manner as a function of the unrolling and/or transporting speed of the tape.

The suction plate 6 is coupled in a releasable manner, for example by way of a quick-release coupling 29 (schematically illustrated in FIG. 1), to the fluid line 8 such that the suction plate 6 can be readily retrieved for maintenance and/or cleaning purposes, and the delay unit 1 can furthermore be equipped with different suction plates 6. It is conceivable for a plurality of suction plates 6 to be provided, said suction plates 6 varying in terms of the dimensions thereof, such that a suction plate 6 which matches in particular in terms of the width, can be assembled tor each type of separating material 2. It is also conceivable for the number, size, and/or the distribution of the suction openings 7 in the suction plate 6 to be adapted to the respective separating material 2 in the case of the different suction plates 6.

Figure 2:
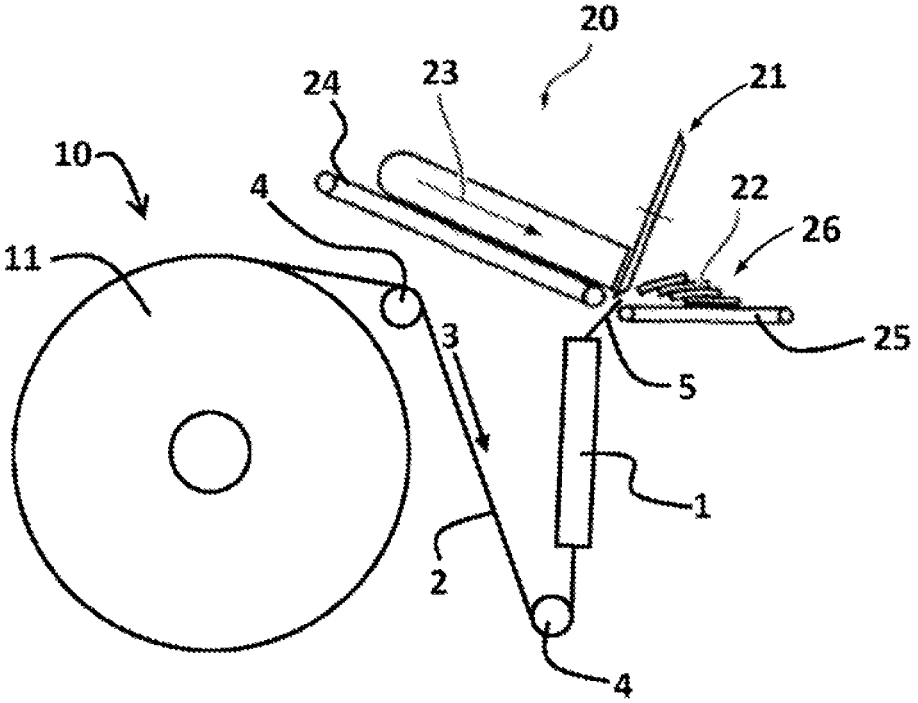
FIG. 2 show s a schematic lateral view of a cutting machine having an unrolling device and a delay unit according to the exemplary embodiment of the present invention.

A schematic lateral view of the cutting machine 20 is illustrated in FIG. 2.

The cutting machine 20 in the present example, apart from the unrolling device 10 explained above by means of FIG. 1, also has a rotating knife 21 and a product infeed 24 and a portioning installation 25. The product infeed 24 serves for feeding one or a plurality of foodstuff bars 23, for example a bar of cheese, sausage, or ham, to the knife 21, on account of which individual foodstuff slices 22 are severed from the foodstuff bar 23. The foodstuff slices 22 thereafter drop onto a transport belt of the portioning installation 25, said transport belt being controlled in such a manner that stacks 26 of at least partially mutually overlapping foodstuff slices 22 are formed on the transport belt.

Individual separating-material leaves 5 with the aid of the unrolling device 10 are injected into the cutting region of the knife 21 in such a manner that one separating-material leaf 5 is in each case disposed between the foodstuff slices 22 that are stacked partially on top of one another, on account of which the stacked foodstuff slices 22 are separated from one another and do not adhere to one another. The separating-material leaves 5 herein are severed from the tape by means of the separate severing installation (not illustrated). The separating-material leaf 5 is in particular incorporated in the cutting region by way of a gap between the knife 21 and the portioning installation 25.

It is conceivable for the rotating speed of the fan wheel to be controlled in an open-loop manner or closed-loop manner as a function of the rotating speed of the knife 21 and/or as a function of the conveying speed of the product infeed by way of which the foodstuff bar 23 is fed to the knife 21.

It is furthermore conceivable for the present cutting machine 20 to be configured as a multi-track cutting machine 20 so that a plurality of foodstuff bars 23 are simultaneously cut and portioned in parallel. In this case, the cutting machine 20 comprises at least a plurality of product infeeds 24 that are disposed in parallel, in particular conveyor belts which are disposed in parallel and are driven in a mutually independent manner, and optionally also a plurality of portioning installations 25 that are disposed in parallel. The plurality of foodstuff bars 23 is however preferably cut by way of the only one knife 21. Accordingly, the unrolling device 10 comprises a multi-track unrolling device so that individual leaves from separating material 2 can be disposed between foodstuff slices 22, stacked on top of one another, of each of the stacks prepared in parallel. The multi-track unrolling dev ice 10 has in particular a plurality of tape rolls 11 that are disposed in parallel in order to provide a plurality of tapes of separating material 2, a corresponding plurality of drives that are disposed in parallel, a corresponding plurality of severing installations that are disposed in parallel, and/or a corresponding plurality of delay units 1 that are disposed in parallel.

LIST OF REFERENCE SIGNS

1 Delay as unit
2 Separating material
3 Transporting movement
4 Deflection roller
5 Separating-material leaf
6 Suction plate
7 Suction opening
8 Fluid line
9 Fan
10 Unrolling dev ice
11 Tape roll
20 Cutting machine
21 Knife
22 Foodstuff slice
23 Foodstuff bar
24 Product infeed
25 Portioning installation
26 Stacks of foodstuff slices 22
27 Control Unit
28 contact pressure means
29 quick release coupling

The invention claimed is:

1. A cutting machine comprising:

a knife, which severs foodstuff slices from at least one foodstuff bar, the foodstuff slices are disposed so as to at least partially overlap so as to form a portion of a plurality of foodstuff slices, an unrolling device providing a separating material on a tape roll, wherein a leaf from the separating material is provided between two of the foodstuff slice, and disposed downstream of the tape roll, wherein the delay unit is configured for delaying a transporting movement of the separating material, which is unrolled from the unrolling device and is provided in a cutting region of the cutting machine, wherein the delay unit has a pressure-generating means for exerting pressure on the separating material, the pressure-generating means comprises a fan, wherein the pressure-generating means comprises a suctioning means for suctioning the separating material by means of negative pressure, wherein the delay unit comprises a control unit for controlling a rotating speed of the fan, the rotating speed of the fan is controlled as a function of an unrolling and/or transporting speed of the separating material, which is measured by means of a sensor, and wherein the fan is controlled by way of a closed-loop control circuit in which the rotating speed of the fan is a manipulated variable and the unrolling and/or transporting speed of the separating material is a regulating and feedback variable.

2. The cutting machine as claimed in claim 1, wherein the suctioning means comprises a suction plate having at least one suction opening, wherein the at least one suction opening by way of a fluid line is fluidically connected to a suction unit.

3. The cutting machine as claimed in claim 1, wherein the cutting machine comprises a suction unit, the suction unit comprises a negative-pressure-generating unit.

4. The cutting machine as claimed in claim 1, wherein a fluid line by way of a quick-release coupling is operatively connected in a releasable manner to the suctioning means.

5. The cutting machine as claimed in claim 1, wherein the pressure-generating means comprises a contact pressure means for pressing the separating material onto a bearing face by means of compressed air, wherein the pressure-generating means has a compressor for generating compressed air, and/or a nozzle for generating an air stream that is directed in a direction of the separating material to press the separating material onto the bearing face.

6. The cutting machine as claimed in claim 1, wherein the knife comprises a rotating cutting knife, and the suctioning means comprises a suction plate having at least one suction opening, which by way of a fluid line is fluidically connected to the fan.

7. A method for providing the separating material in the cutting region of the cutting machine of claim 1, the method comprising:

unrolling the separating material from the tape roll and providing the separating material in the cutting region, delaying the transporting movement of the separating material from the tape roll to the cutting region by the delay unit, generating the pressure on the separating material by means of the pressure-generating means for delaying the transporting movement, and suctioning the separating material by means of the negative pressure by the suctioning means.

8. The method as claimed in claim 7, wherein the separating material is suctioned in a planar manner onto a suction plate during the delaying step, wherein the negative pressure is generated by the fan, the fan is fluidically connected to at least one suction opening in the suction plate with a fluid line.

9. The method as claimed in claim 8, wherein the rotating speed of the fan is controlled by the control unit as a function of rotating speed of the knife of the cutting machine and/or of a conveying speed of the foodstuff bar in a direction of the knife.

10. The method as claimed in claim 7, wherein the separating material is pressed against a bearing face of a suction plate by a contact pressure means.

11. The method as claimed in claim 7, wherein the foodstuff slices are severed from the foodstuff bar by means of the knife, and wherein the foodstuff slices are disposed so as to at least partially overlap so as to form the portion of the plurality of foodstuff slices, wherein the leaf that is severed from the separating material is disposed between at least two foodstuff slices.

* * * * *